US008000079B2

(12) United States Patent
Lin

(10) Patent No.: US 8,000,079 B2
(45) Date of Patent: Aug. 16, 2011

(54) RELAY DRIVING MODULE AND AN ELECTRONIC DEVICE INCORPORATING THE SAME

(75) Inventor: Shun-Chang Lin, Taipei (TW)

(73) Assignees: Silitek Electronics (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 303 days.

(21) Appl. No.: 12/285,902

(22) Filed: Oct. 16, 2008

(65) Prior Publication Data

US 2009/0290277 A1 Nov. 26, 2009

(30) Foreign Application Priority Data

May 22, 2008 (CN) ..... 2008 1 0097647

(51) Int. Cl.
*H01H 47/00* (2006.01)

(52) U.S. Cl. ..... 361/167; 361/166; 361/170

(58) Field of Classification Search ..... 361/167, 361/166, 170

See application file for complete search history.

(56) References Cited

U.S. PATENT DOCUMENTS

| | | | | |
|---|---|---|---|---|
| 3,829,683 | A * | 8/1974 | Long et al. | 250/208.4 |
| 4,418,374 | A | 11/1983 | Callan | |
| 4,961,051 | A * | 10/1990 | Tjebben | 324/415 |
| 5,079,667 | A | 1/1992 | Kasano et al. | |
| 5,099,384 | A * | 3/1992 | Chin | 361/166 |
| 6,089,456 | A * | 7/2000 | Walsh et al. | 235/472.01 |
| 6,414,833 | B1 * | 7/2002 | Estudillo | 361/152 |

* cited by examiner

*Primary Examiner* — Patrick Salce
(74) *Attorney, Agent, or Firm* — Rosenberg, Klein & Lee

(57) ABSTRACT

A relay driving module is adapted for driving a latching relay, and includes a current limiting circuit, an energy storage component, and a switch circuit. The current limiting circuit is adapted for receiving a power signal, and draws an amount of current that does not exceed a current threshold from the power signal. The energy storage component is coupled electrically to the current limiting circuit for receiving the current from the current limiting circuit so as to store energy therein. The switch circuit is coupled electrically to the energy storage component, and is controlled by a control signal to selectively enable the energy storage component to discharge the energy stored therein so as to drive the latching relay.

12 Claims, 6 Drawing Sheets

RELAY DRIVING MODULE AND AN ELECTRONIC DEVICE INCORPORATING THE SAME

CROSS-REFERENCE TO RELATED APPLICATION

This application claims priority of Chinese Application No. 200810097647.5, filed on May 22, 2008.

BACKGROUND OF THE INVENTION

1. Field of the Invention

The invention relates to a relay driving module, more particularly a relay driving module for driving a latching relay with a limited amount of current.

2. Description of the Related Art

A relay is normally used as a switch, e.g., a power switch, in an electronic device. A latching relay consumes power only during switching between an on state and an off state (also referred to as a reset state).

With reference to FIG. 1, U.S. Pat. No. 5,079,667 discloses a conventional relay driving circuit that includes an input voltage level detector 81, a set switch 84, a relay 85, and a reset switch 86. The input voltage level detector 81 detects an input voltage ($V_{in}$) at an input side, and turns on the set switch 84 when the input voltage ($V_{in}$) is greater than a threshold value so as to provide a set current for driving the relay 85 to turn on. On the other hand, when the input voltage ($V_{in}$) is smaller than the threshold value, the input voltage level detector 81 turns on the reset switch 86 so as to turn off the relay 85.

With reference to FIG. 2, U.S. Pat. No. 4,418,374 discloses another conventional relay driving circuit that includes a resistor 93 across an input side, a capacitor 94, a programmable controller 95, a relay including a set inductor 97, and first and second switches 96, 99. As the input voltage ($V_{in}$) across the resistor 93 increases, and the capacitor 94 is charged. When the voltage across the resistor 93 exceeds a reference voltage provided by the programmable controller 95, the programmable controller 95 turns on the first switch 96 such that the voltage across the resistor 93 is couple to the set inductor 97 for turning on the relay. On the other hand, when the input voltage ($V_{in}$) is lower than the reference voltage, the programmable controller 95 turns off the first switch 96, and turns on the second switch 99, such that the capacitor 94 discharges through the reset inductor 90 and the second switch 99, thereby turning off the relay.

Furthermore, as shown in FIG. 3, a conventional power supply system for a liquid crystal display operates as follows. When the liquid crystal display operates under an operating mode, a power supplying member 71 supplies power to a control circuit 72 and a liquid crystal display panel 73 for normal operations, where the control circuit 72 transmits a display signal to the liquid crystal display panel 73 for image display thereby. When the liquid crystal display enters a power saving mode, power is no longer supplied to the liquid crystal display panel 73, but is still supplied to the control circuit 72 such that the control circuit 72 can switch back to the operating mode at any time upon receipt of the display signal. In other words, under the power saving mode, the power supplying member 71 still needs to supply power to the control circuit 72, resulting in continuous consumption of power that accumulates to a significant amount in the long run.

SUMMARY OF THE INVENTION

Therefore, the object of the present invention is to provide a relay driving module that is capable of driving a latching relay with a limited amount of current, and an electronic device incorporating such a relay driving module.

Under the present technology, a power signal is transmitted along with the display signal to the liquid crystal display. The applicant realized the possibility of using the power signal to provide the power necessary for switching operation of the liquid crystal display from the power saving mode to the operating mode, such that no extra power from the power supplying member 71 (as shown in FIG. 3) is necessary. The applicant initially thought about using a latching relay to cut off the power supplying member 71 upon input of the display signal and the power signal, and then using the power signal to provide the necessary power for driving the control circuit 72 and the latching relay so as to switch the liquid crystal display from operating in the power saving mode to the operating mode. However, the power provided by the power signal is only sufficient for driving one, not both, of the control circuit 72 and the latching relay. Therefore, in search for a solution to this problem, the applicant came up with the present invention.

According to one aspect of the present invention, there is provided a relay driving module that is adapted for driving a latching relay. The relay driving module includes a current limiting circuit, an energy storage component, and a switch circuit. The current limiting circuit is adapted for receiving a power signal, and draws an amount of current that does not exceed a current threshold from the power signal. The energy storage component is coupled electrically to the current limiting circuit for receiving the current from the current limiting circuit so as to store energy therein. The switch circuit is coupled electrically to the energy storage component, and is controlled by a control signal to selectively enable the energy storage component to discharge the energy stored therein so as to drive the latching relay.

According to another aspect of the present invention, there is provided an electronic device that includes a control unit, a current limiting circuit, an energy storage component, a latching relay, and a switch circuit. The control unit generates a control signal according to an external signal. The current limiting circuit receives the external signal, and draws an amount of current that does not exceed a current threshold from the external signal. The energy storage component is coupled electrically to the current limiting circuit for receiving the current from the current limiting circuit so as to store energy therein. The latching relay is coupled electrically to a common node of the current limiting circuit and the energy storage component. The switch circuit is coupled electrically to the energy storage component, and is controlled by the control signal to selectively enable the energy storage component to discharge the energy stored therein so as to drive the latching relay.

The latching relay can be a single-coil latching relay or a two-coil latching relay.

When the latching relay is a two-coil latching relay, the latching relay includes a switch, and first and second coils. The common node of the current limiting circuit and the energy storage component is to be connected electrically to first terminals of the first and second coils of the latching relay. The switch circuit includes: a first transistor coupled electrically to a second terminal of the first coil of the latching relay, and controlled by a first one of the control signals to selectively enable the energy storage component to discharge the energy stored therein to the first coil of the latching relay for turning off the switch of the latching relay; and a second transistor coupled electrically to the second terminal of the second coil of the latching relay, and controlled by a second one of the control signals to selectively enable the energy storage component to discharge the energy stored therein to the second coil of the latching relay for turning on the switch of the latching relay.

When the latching relay is a single-coil latching relay, the latching relay includes a switch and a coil. The switch circuit is controlled by two of the control signals to selectively enable the energy storage component to discharge the energy stored therein to the coil of the latching relay in two opposite directions for respectively turning on and off the switch of the latching relay.

The switch of the latching relay has a first terminal that is adapted to be connected electrically to an external power source, and a second terminal that is connected electrically to a power supplying member for transmitting power supplied by the external power source to the power supplying member when the switch is turned on, so as to enable the power supplying member to drive operation of the main operating component.

Preferably, the current limiting circuit is one of a resistor, a constant current circuit, and a constant current limiter, and the energy storage component is one of a capacitor and a rechargeable battery.

The effect of the present invention resides in that the current limiting circuit limits the amount of current drawn thereby, and that by utilizing the energy storage component to store energy therein from the current drawn by the current limiting circuit, energy sufficient for driving the latching relay may be acquired from a limited current source. Therefore, an electronic device incorporating the relay driving module of the present invention does not need to consume any internal power when operating under a power saving mode in order to switch back to operating in an operating mode, and can simply use an external signal to switch back to operating in the operating mode.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
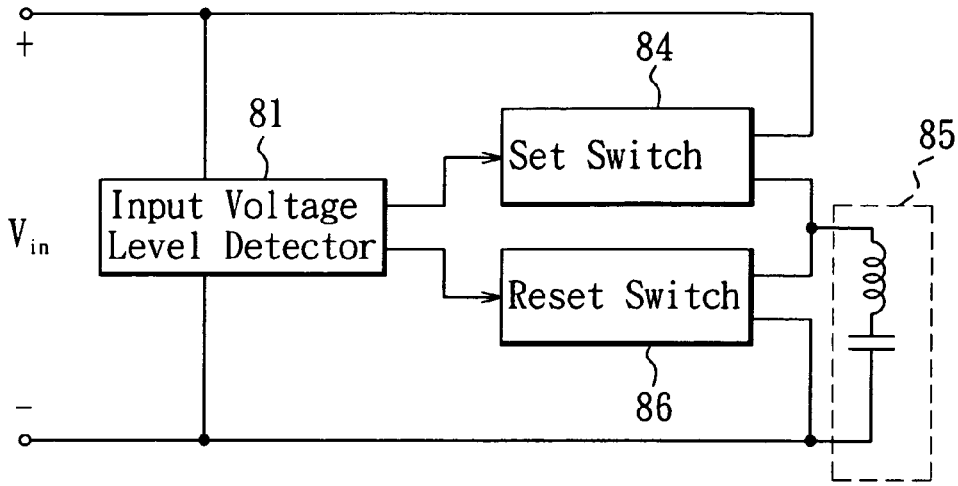
FIG. 1 PRIOR ART
FIG. 1 is a circuit block diagram, illustrating a conventional relay driving circuit disclosed in U.S. Pat. No. 5,079,667.
Figure 2:
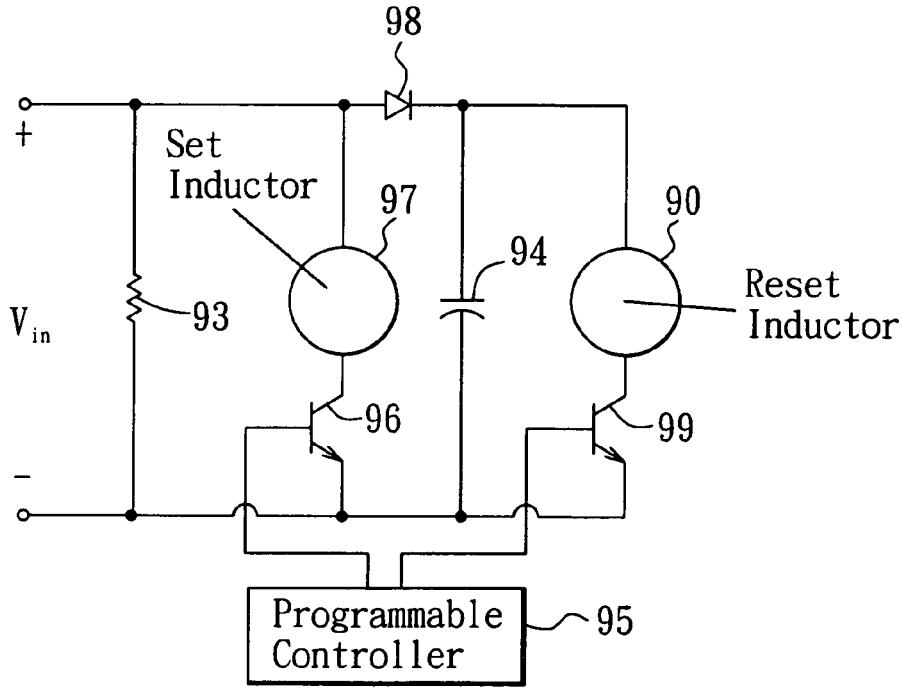
FIG. 2 PRIOR ART
FIG. 2 is a circuit block diagram, illustrating another conventional relay driving circuit disclosed in U.S. Pat. No. 4,418,374.
Figure 3:
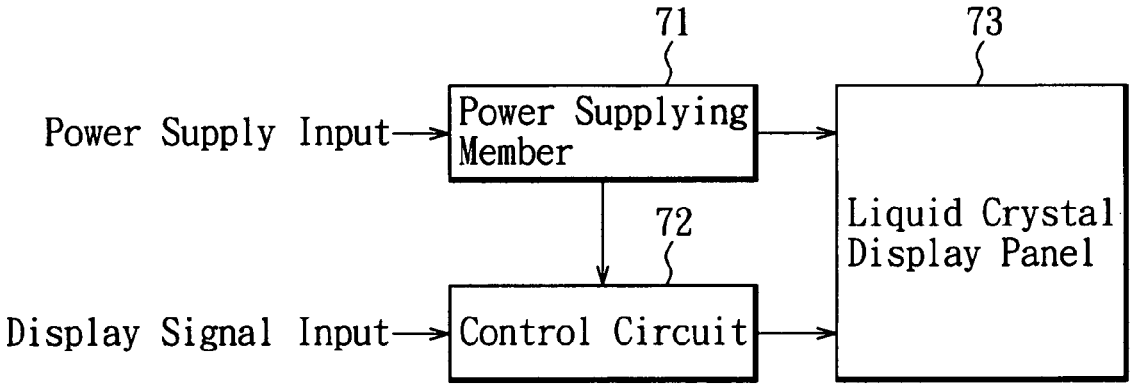
FIG. 3 PRIOR ART
FIG. 3 is a block diagram, illustrating a conventional power supply system for a liquid crystal display.

Before the present invention is described in greater detail, it should be noted that like elements are denoted by the same reference numerals throughout the disclosure.

Figure 4:
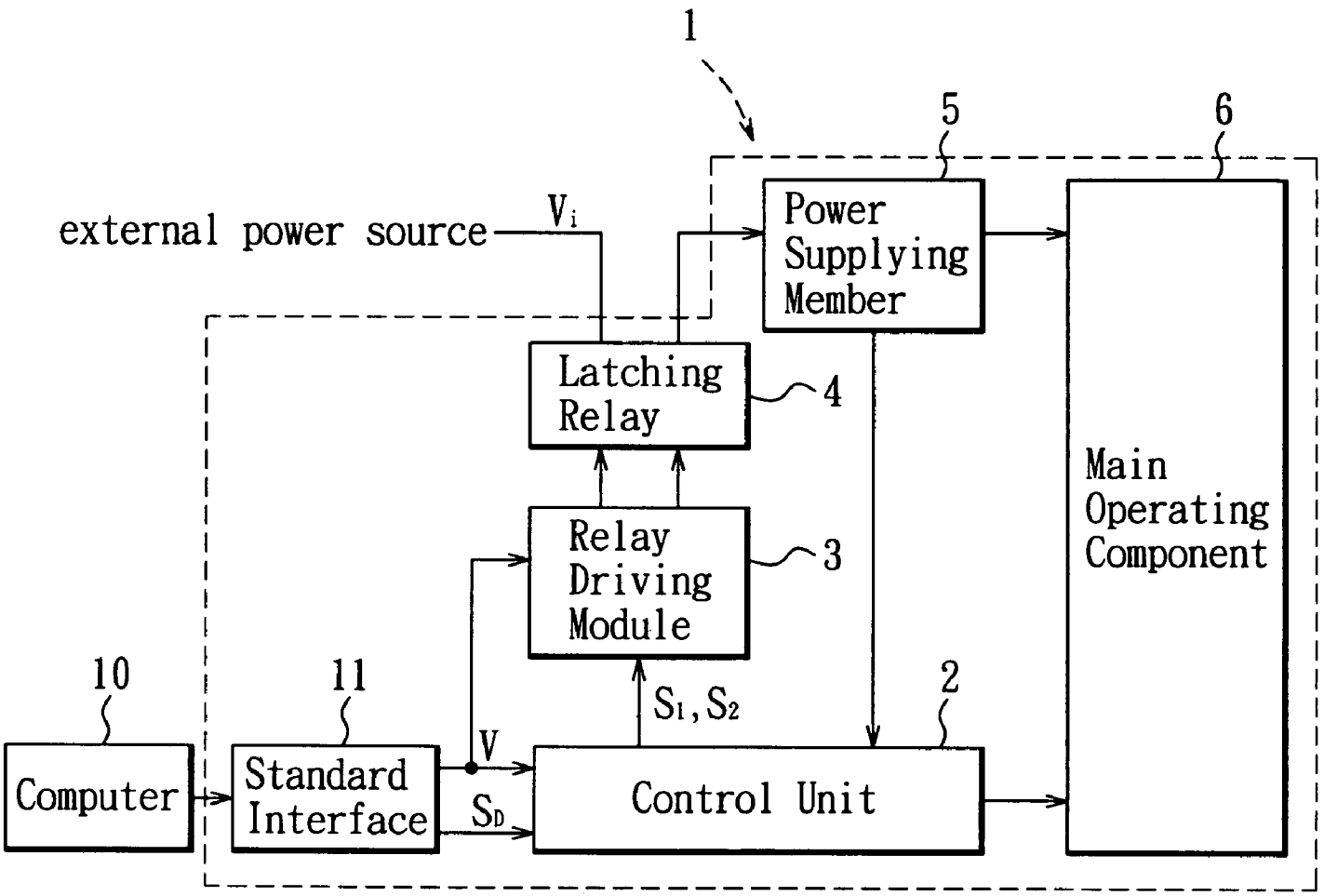
FIG. 4 is a block diagram, illustrating the first preferred embodiment of an electronic device incorporating a relay driving module according to the present invention.

Referring to FIG. 4, the first preferred embodiment of an electronic device 1 according to the present invention includes a control unit 2, a relay driving module 3, a latching relay 4, a power supplying member 5, and a main operating component 6. In this embodiment, the electronic device 1 is a liquid crystal display, and the main operating component 6 is a liquid crystal display panel The power supplying member 5 is connected electrically to the main operating component 6 for driving operation of the main operating component 6. The relay driving module 3 is used to drive the latching relay 4 so as to turn the power supplying member 5 on/off, such that the electronic device 1 does not consume power when operating in a power saving mode. It should be noted herein that although the electronic device 1 is implemented as a liquid crystal display in this embodiment, the present invention is not limited thereto in other embodiments. In other words, other electronic devices that can switch between a power saving mode and an operating mode, such as a television, a computer, etc., can also incorporate the relay driving module 3 of the present invention.

The electronic device 1 further includes a standard interface 11 adapted for connecting to a computer 10 (e.g., a personal computer (PC) or a notebook computer) so as to receive an external signal therefrom. The standard interface 11 may be an image signal transmission interface, such as a video graphic array (VGA), a digital video interface (DVI), a high definition multimedia interface (HDMI), etc.

The control unit 2 is connected electrically to the standard interface 11 for receiving the external signal from the computer 10 via the standard interface 11, and generates a control signal according to the external signal. In this embodiment, the external signal is a display signal for a liquid crystal display, and includes a power signal component (V) and an image signal component ($S_D$). The control unit 2 generates the control signal according to the image signal component ($S_D$). The control unit 2 includes an image scaling chip that processes the image signal component ($S_D$), and that transmits the processed image signal component to the main operating component 6.

The latching relay 4 is adapted to be connected electrically to an external power source ($V_i$), and is connected to the power supplying member 5 for controlling whether power supplied by the external power source ($V_i$) is to be transmitted to the power supplying member 5.

When the electronic device 1 operates in an operating mode, the external signal, which includes the power signal component (V) and the image signal component ($S_D$), is supplied to the control unit 2 via the standard interface 11. During operation in the operating mode, the latching relay 4 permits the power supplied by the external power source ($V_i$) to be transmitted to the power supplying member 5, so as to enable the power supplying member 5 to drive operation of the control unit 2 and the main operating component 6, thereby enabling the control unit 2 to process the image signal component ($S_D$) of the external signal for subsequent transmission to the main operating component 6 thereby. Furthermore, the external power source ($V_i$) may be any available power supply, examples of which include commercial electricity, batteries, etc.

Figure 5:
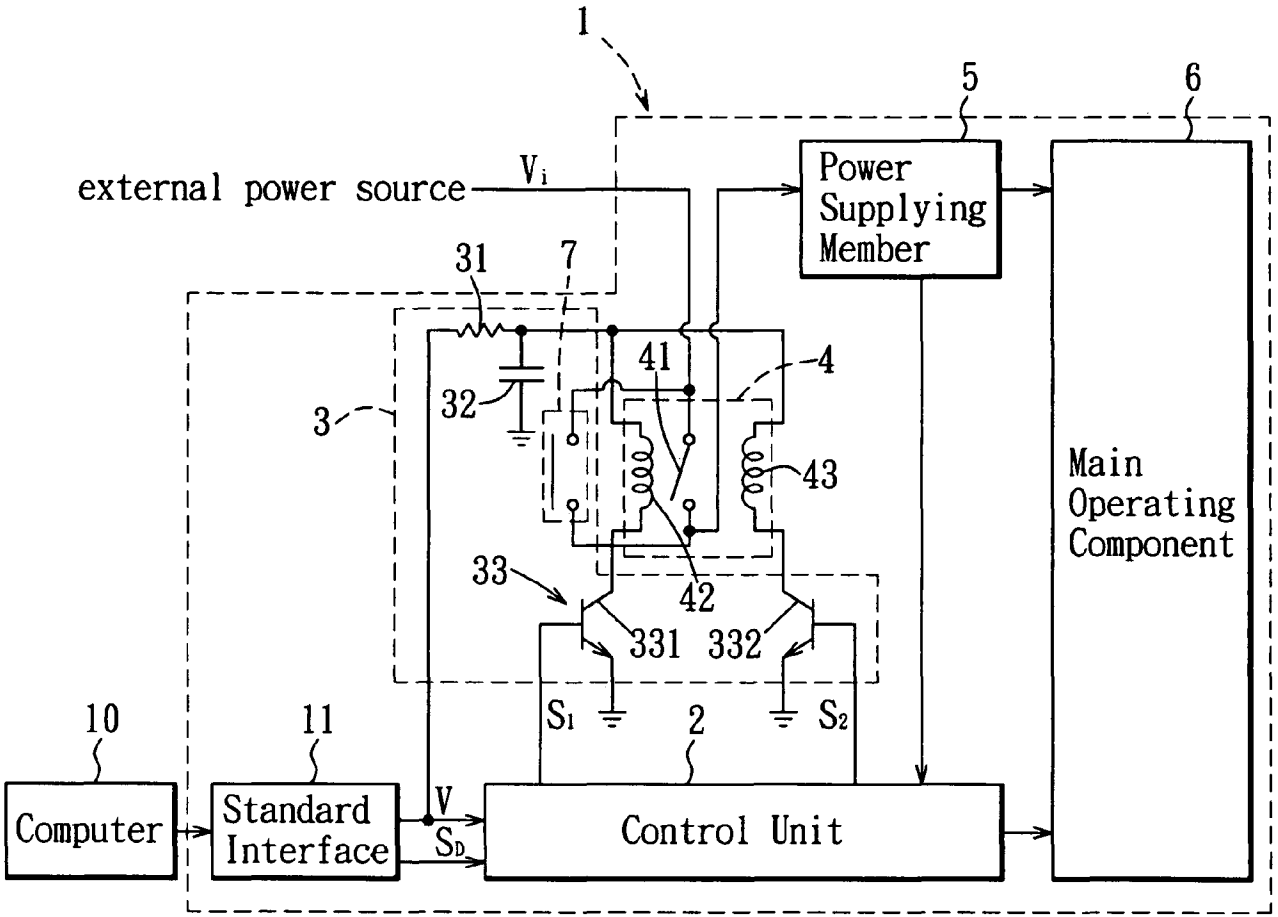
FIG. 5 is a circuit block diagram of a first implementation of the first preferred embodiment.

As shown in FIG. 5, the relay driving module 3 includes a current limiting circuit 31, an energy storage component 32, and a switch circuit 33.

The current limiting circuit 31 is coupled electrically to the standard interface 11 so as to receive the power signal component (V) of the external signal therefrom, and draws an amount of current that does not exceed a current threshold from the power signal component (V). The current limiting circuit 31 may be one of a resistor, a constant current circuit, and a constant current limiter. In this embodiment, the current limiting circuit 31 is a resistor.

The energy storage component 32 is coupled electrically to the current limiting circuit 31 for receiving the current from the current limiting circuit 31 so as to store energy therein. The switch circuit 33 is coupled electrically to the energy storage component 32, and is controlled by a control signal to selectively enable the energy storage component 32 to discharge the energy stored therein so as to drive the latching relay 4. The latching relay 4 is coupled electrically to a common node of the current limiting circuit 31 and the energy storage component 32. The energy storage component 32 may be one of a capacitor and a rechargeable battery. In this embodiment, the energy storage component 32 is a capacitor.

In this embodiment, the latching relay 4 is a two-coil latching relay, e.g., DK relays and ST relays manufactured by Panasonic (Matsushita Electric Industrial Co., Ltd.), JE8 relays manufactured by Xiamen HONGFA Electroacoustic Co. Ltd., and G6B relays manufactured by OMRON Corporation. The latching relay 4 includes a switch 41, and first and second coils 42, 43. The switch 41 has a first terminal that is adapted to be connected electrically to the external power source ($V_i$), and a second terminal that is connected electrically to the power supplying member 5 for transmitting power supplied by the external power source ($V_i$) to the power supplying member 5 when the switch 41 is turned on, so as to enable the power supplying member 5 to drive operation of the main operating component 6. Each of the first and second coils 42, 43 has first and second terminals. The common node of the current limiting circuit 31 and the energy storage component 32 is connected electrically to the first terminals of the first and second coils 42, 43 of the latching relay 4.

The switch circuit 33 is controlled by two of the control signals ($S_1$, $S_2$), and includes first and second transistors 331, 332. The first transistor 331 is coupled electrically to the second terminal of the first coil 42 of the latching relay 4, and is controlled by a first one of the control signals ($S_1$) to selectively enable the energy storage component 32 to discharge the energy stored therein to the first coil 42 of the latching relay 4 for turning off the switch 41 of the latching relay 4. The second transistor 332 is coupled electrically to the second terminal of the second coil 43 of the latching relay 4, and is controlled by a second one of the control signals ($S_2$) to selectively enable the energy storage component 32 to discharge the energy stored therein to the second coil 43 of the latching relay 4 for turning on the switch 41 of the latching relay 4.

Since the current limiting circuit 31 is coupled electrically to the standard interface 11 and the energy storage component 32 for transferring the power signal component (V) from the standard interface 11 to the energy storage component 32, the energy storage component 32 remains charged up when the electronic device 1 operates in the operating mode.

When the control unit 2 determines that the image signal component ($S_D$) of the external signal outputted by the standard interface 11 is maintained at a logic low level for a first predetermined duration (e.g., 5 minutes), the control unit 2 controls the electronic device 1 to switch from the operating mode to the power saving mode in order to save power. Simultaneously, the control unit 2 generates the first one of the control signals (hereinafter referred to as the first control signal ($S_1$)) to control the first transistor 331 to enable the energy storage component 32 to discharge the energy stored therein to the first coil 42 of the latching relay 4, such that a magnetic field is generated in the first coil 42 for turning off the switch 41 of the latching relay 4. Consequently, the electrical connection between the power supplying member 5 and the external power source ($V_1$) is cut off, thereby turning off the power supplying member 5. It should be noted herein that all electronic components of the electronic device 1, including the control unit 2, the power supplying member 5, and the main operating member 6, do not consume power when the electronic device 1 operates in the power saving mode. Therefore, zero power consumption is achieved.

On the other hand, when the external signal generated by the computer 10 and outputted via the standard interface 11 transitions from the logic low level to a logic high level, the control unit 2 starts receiving the power provided by the power signal component (V) of the external signal. Simultaneously, the current limiting circuit 31 receives the power signal component (V) of the external signal, and directs the current to the energy storage component 32 so as to store energy therein. When the control unit 2 determines that the energy stored in the energy storage component 32 is sufficient for driving the latching relay 4, the control unit 2 generates the second one of the control signals (hereinafter referred to as the second control signal ($S_2$)) to control the second transistor 332 to enable the energy storage component 32 to discharge the energy stored therein to the second coil 43 of the latching relay 4, such that a magnetic field is generated in the second coil 43 for turning on the switch 41 of the latching relay 4. Consequently, the electrical connection is established between the power supplying member 5 and the external power source ($V_1$), thereby turning on the power supplying member 5, which in turn supplies power to the control unit 2 and the main operating component 6 for switching the electronic device 1 to operate from the power saving mode to the operating mode, where the control unit 2 operates according to the image signal component ($S_D$) of the external signal.

In this embodiment, the control unit 2 determines that the energy stored in the energy storage component 32 is sufficient for driving the latching relay 4 by determining that a second predetermined duration has elapsed since the external signal transitions from the logic low level to the logic high level. The second predetermined duration may be a charging time for the energy storage component 32 previously set in the control unit 2, or may be a charging time for the energy storage component 32 that is calculated by a pre-stored program in the control unit 2.

It should be noted herein that the relay driving module 3 of the present invention utilizes the current limiting circuit 31 to limit the amount of current that is drawn thereby from the power signal component (V) of the external signal, and further utilizes the energy storage component 32 to store sufficient energy therein for driving the latching relay 4 in order to achieve the effect of using a limited amount of current to drive the latching relay 4, so as to ensure that sufficient power of the power signal component (V) is available for driving the control unit 2 when the electronic device 1 is to switch operation from the power saving mode to the operating mode. Consequently, the power signal component (V) of the external signal provides sufficient power for driving both the latching relay 4 and the control unit 2 when the electronic device 1 is to switch operation from the power saving mode to the operating mode.

In this embodiment, the power signal component (V) includes a current component and a voltage component. The current limiting circuit 31, which is the resistor, has a resistance of at least the voltage component of the power signal component (V) divided by the current threshold of the current limiting circuit 31.

Exemplary design parameters for the present invention are provided hereinbelow with reference to the liquid crystal display implementing the electronic device 1 according to this embodiment of the present invention. The power signal component (V) of the external signal transmitted by the computer 10 via the standard interface 11 to the liquid crystal display has a current of 50 mA and a voltage of 5V. The amount of current required by the control unit 2 during switching of the liquid crystal device from the power saving mode to the operating mode is approximately 40 mA. For the latching relay 4, the required driving current is 45 mA, the allowable voltage drop of the driving voltage is 1V, and the driving time is 45 mS. Therefore, in order to ensure that 40 mA of current is supplied to the control unit 2 for the control unit 2 to generate the second control signal ($S_2$), the current threshold of the current limiting unit 31 is the amount of current supplied by the power signal component (V) subtracted by the amount of current required for driving the control unit 2, which is 10 mA (50 mA−40 mA=10 mA) in this example. Therefore, the resistance of the resistor (i.e., the current limiting unit 31) is at least 500Ω (V/I=5V/10 mA=500Ω). The energy storage component 32, which is the capacitor, can have a capacitance of 2025 μF (C=I*t/V=45 mA*45 mS/1V). The charging time for the capacitor is 1012.5 mS (RC time=500Ω*2025 μF). In other words, the second predetermined duration is 1012.5 mS. When the electronic device 1 operates in the power saving mode, upon determining that 1012.5 mS has elapsed since the external signal transitions from the logic low level to the logic high level, the control unit 2 generates the second control signal ($S_2$) to control the switch circuit 33.

Therefore, with the cooperation between the current limiting circuit 31 and the energy storage component 32, the relay driving module 3 of the present invention is capable of using a relatively small amount of current to drive the latching relay 4 as compared to the prior art, such that the relay driving module 3 is more easily applicable to operating environments with a limited amount of current supply. Moreover, even if the current component of the power signal component (V) of the external signal is less than the total amount of current required by the control unit 2 and the latching relay 4 combined when the electronic device 1 is to switch from the power saving mode to the operating mode, as long as the current component of the power signal component (V) is slightly greater than that required by the control unit 2, the rest of the current can be used to drive the latching relay 4 by utilizing the current limiting circuit 31 and the energy storage component 32. Consequently, the electronic device 1 can simply use the external signal generated by the computer 10 to switch operation from the power saving mode to the operating mode without having to use the power supplying member 5 to supply power to the electronic components within the electronic device 1 when the latter operates in the power saving mode, thereby achieving zero power consumption when operating in the power saving mode.

Moreover, the electronic device 1 further includes a by-pass switch 7 that is adapted to be connected electrically between the power supplying member 5 and the external power source ($V_i$) in parallel with the switch 41 of the latching relay 4. The by-pass switch 7 is accessible to a user of the electronic device 1, and enables the power supplied by the external power source ($V_i$) to be transmitted to the power supplying member 5 when the by-pass switch 7 is turned on. Therefore, when the electronic device 1 operates in the power saving mode, and when the image signal component ($S_D$) of the external signal generated by the computer 10 remains at the logic low level, the user can turn on the by-pass switch 7 to enable the power supplied by the external power source ($V_i$) to be transmitted to the power supplying member 5 for driving the control unit 2 to thereby switch the operation of the electronic device 1 from the power saving mode back to the operating mode.

Figure 6:
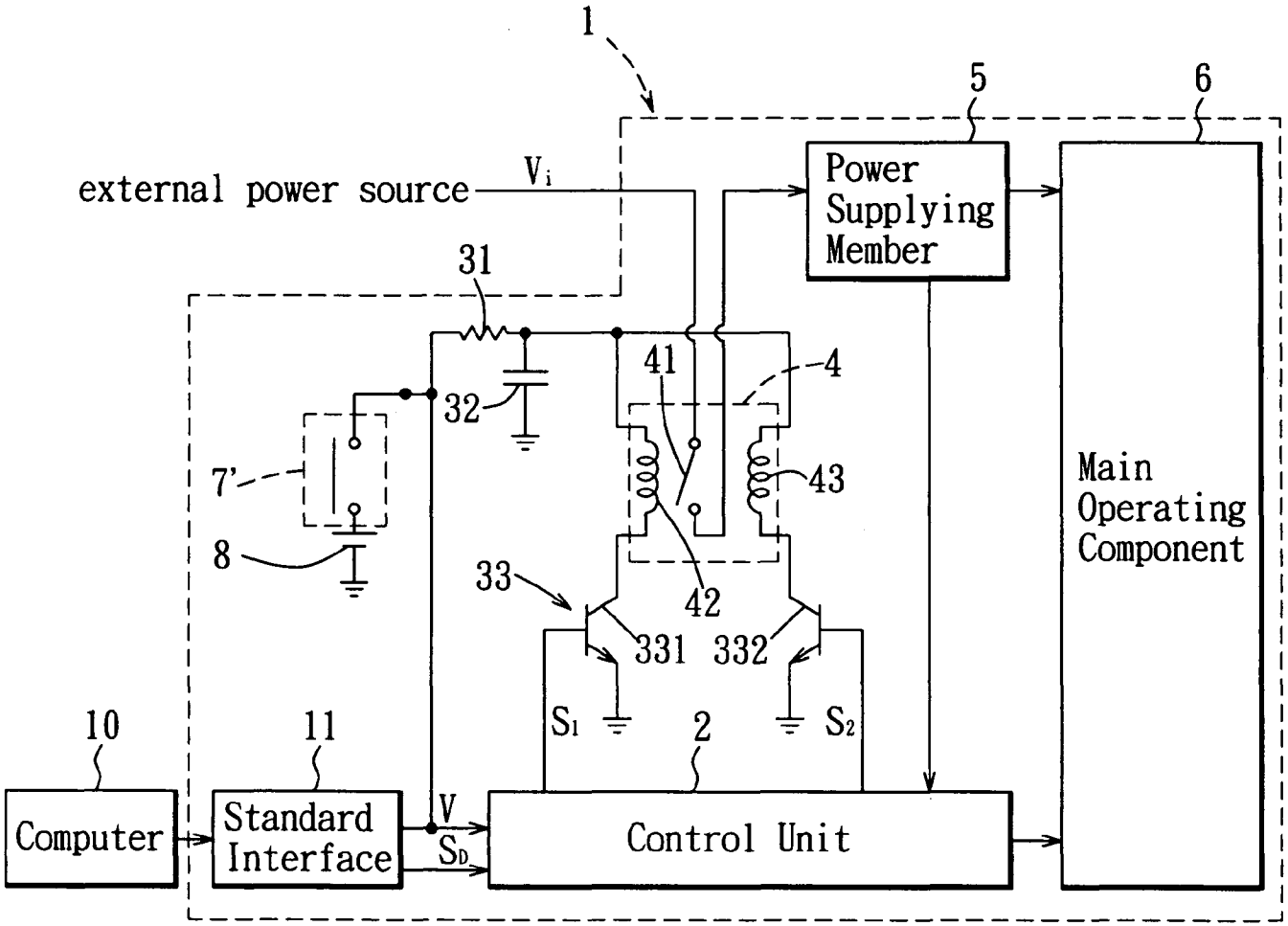
FIG. 6 is a circuit block diagram of a second implementation of the first preferred embodiment.

Alternatively, as shown in FIG. 6, the electronic device 1 may further include an internal power source 8, and a backup switch 7' that is coupled electrically between the internal power source 8 and the current limiting circuit 31 of the relay driving module 3 opposite to the energy storage component 32. The backup switch 7' is accessible by the user, and enables current to be transmitted from the internal power source 8 through the current limiting circuit 31 to the energy storage component 32 for storing energy therein when the backup switch 7' is turned on. The control unit 2 is also coupled electrically to the backup switch 7' opposite to the internal power source 8, such that the control unit 2 is able to generate the second control signal ($S_2$) for switching the electronic device 1 to operate from the power saving mode to the operating mode, or to generate the first control signal ($S_1$) for switching the electronic device 1 to operate from the operating mode to the power saving mode. In this embodiment, the internal power source 8 is a battery.

Figure 7:
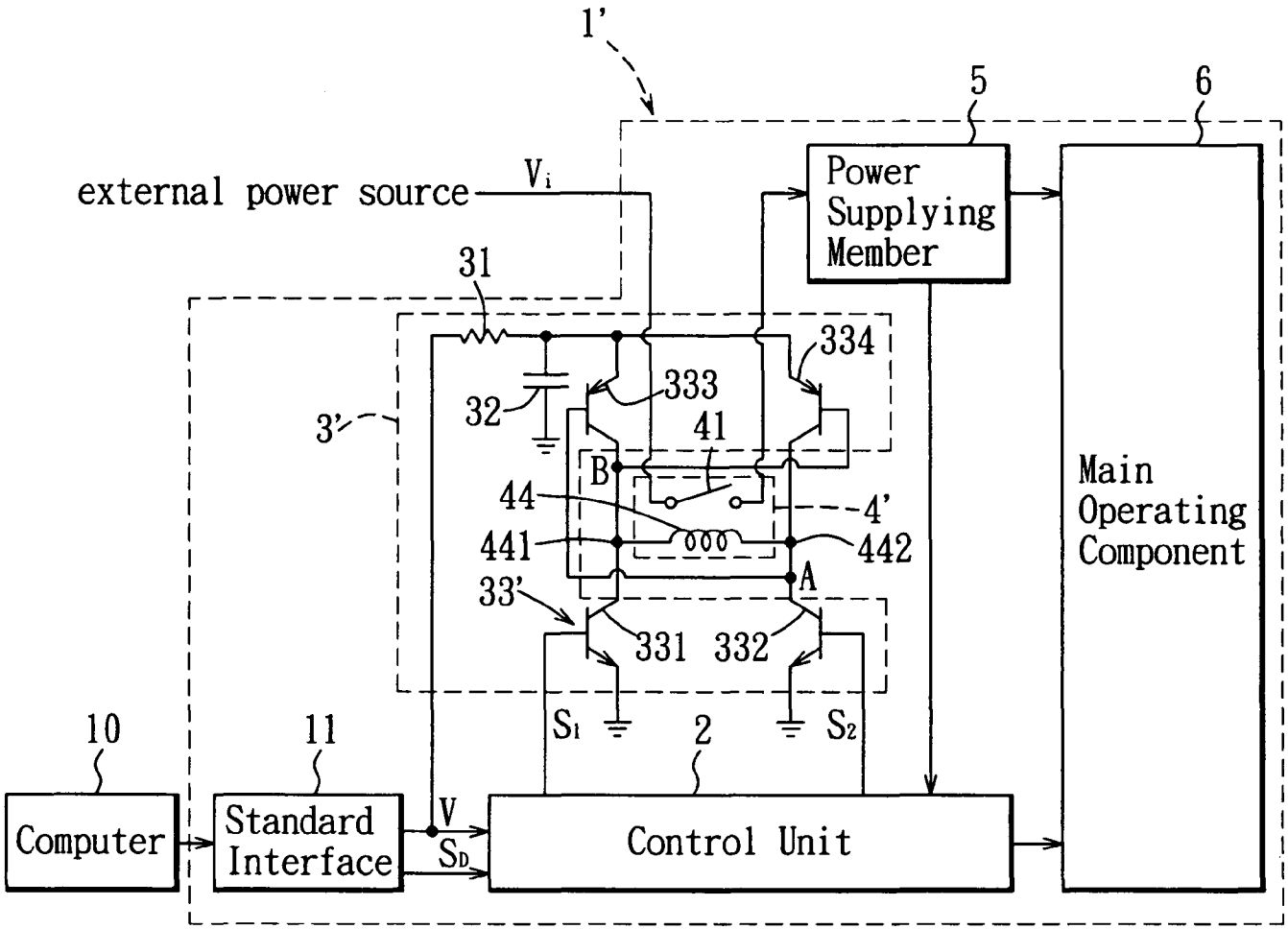
FIG. 7 is a circuit block diagram, illustrating the second preferred embodiment of an electronic device incorporating a relay driving module according to the present invention.

With reference to FIG. 7, the second preferred embodiment of an electronic device 1' according to the present invention differs from the first preferred embodiment (as shown in FIG. 5) mainly in that the latching relay 4' of the electronic device 1' according to the second preferred embodiment is a single-coiled latching relay. The latching relay 4' includes a switch 41 and a coil 44 that has first and second terminals 441, 442. In this embodiment, the switch circuit 33' includes a first transistor 331, a second transistor 332, a third transistor 333, and a fourth transistor 334. The first transistor 331 is coupled electrically to the first terminal 441 of the coil 44 of the latching relay 4'. The second transistor 332 is coupled electrically to the second terminal 442 of the coil 44 of the latching relay 4'. The third transistor 333 is coupled electrically between the energy storage component 32 and the first terminal 441 of the coil 44. The fourth transistor 334 is coupled electrically between the energy storage component 32 and the second terminal 442 of the coil 44. The third and fourth transistors 333, 334 are respectively controlled to turn on/off by voltages at terminals (A), (B), which are respectively connected electrically to the second and first terminals 441, 442 of the coil 44.

The first transistor 331 is controlled by the first control signal ($S_1$) to selectively turn on the fourth transistor 334 and enable the energy storage component 32 to discharge the energy stored therein to the coil 44 of the latching relay 4' for turning on the switch 41 of the latching relay 4'. In particular, the first control signal ($S_1$) generated by the control unit 2 controls the first transistor 331 to enable the energy storage component 32 to discharge the energy stored therein through the fourth transistor 334 to the coil 44 of the latching relay 4' for turning on the switch 41 of the latching relay 4' when the second predetermined duration has elapsed since the external signal transitions from the logic low level to the logic high level.

The second transistor 332 is controlled by the second control signal ($S_2$) to selectively turn on the third transistor 333 and enable the energy storage component 32 to discharge the energy stored therein to the coil 44 of the latching relay 4' for turning off the switch 41 of the latching relay 4'. In particular, the second control signal ($S_2$) generated by the control unit 2 controls the second transistor 332 to enable the energy storage component 32 to discharge the energy stored therein through the third transistor 333 to the coil 44 of the latching relay 4' for turning off the switch 41 of the latching relay 4' when the image signal component ($S_D$) of the external signal is maintained at the logic low level for the first predetermined duration.

When the control unit 2 determines that the image signal component ($S_D$) of the external signal outputted by the standard interface 11 is maintained at the logic low level for the first predetermined duration, the control unit 2 controls the electronic device 1 to switch operation from the operating mode to the power saving mode in order to save power. In particular, the second control ($S_2$) generated by the control unit 2 turns on the second transistor 332, thereby pulling the voltage at the terminal (A) to zero, which in turn turns on the third transistor 333. At this time, the energy storage component 32 discharges the energy stored therein through the third transistor 333 to the coil 44 of the latching relay 4', thereby generating a magnetic field in the coil 44 for turning off the switch 41 of the latching relay 4'. Consequently, the electrical connection between the power supplying member 5 and the external power source ($V_i$) is cut off, such that the power supplying member 5 no longer receives power from the external power source ($V_i$).

When the external signal generated by the computer 10 transitions from the logic low level to the logic high level, the energy storage component 32 starts storing energy from the power signal component (V) of the external signal generated by the computer 10 and passing through the current limiting circuit 31, and the control unit 2 starts receiving the power provided by the power signal component (V) of the external signal. When the control unit 2 determines that the second predetermined duration has elapsed since the external signal transitions from the logic low level to the logic high level, the control unit 2 generates the first control signal ($S_1$) to turn on the first transistor 331. As a result, the voltage at terminal (B) is pulled down to zero, thereby turning on the fourth transistor 334. At this time, the energy storage component 32 discharges the energy stored therein through the fourth transistor 334 to the coil 44 of the latching relay 4', thereby generating a magnetic field in the coil 44 for turning on the switch 41 of the latching relay 4'. Consequently, the electronic device 1' is switched from operating in the power saving mode to the operating mode, and the power is supplied to the power supplying member 5 from the external power source ($V_i$).

It should be noted herein that, since the rest of the operations of the electronic device 1' of the second preferred embodiment are identical to those of the first embodiment, further details are omitted herein for the sake of brevity.

In sum, with the cooperation between the current limiting circuit 31 and the energy storage component 32, the relay driving module 3, 3' of the present invention is capable of using a relatively small amount of current to drive the latching relay 4, 4' as compared to the prior art, such that the relay driving module 3, 3' is more easily applicable to operating environments with a limited amount of current supply. Moreover, the electronic device 1, 1' incorporating the relay driving module 3, 3' according to the present invention consumes no power when operating in the power saving mode. Once the external signal generated by the computer 10 transitions from the logic low level to the logic high level, the power signal component (V) of the external signal supplies the power necessary for operation of the control unit 2 and the relay driving module 3, 3', where the energy storage component 32 of the relay driving module 3, 3' stores energy from the small amount of current drawn by the current limiting circuit 31 of the relay driving module 3, 3' until the energy is sufficient for driving the latching relay 4, 4', at which time the control unit 2 generates the corresponding control signal ($S_1$, $S_2$) (depending on the particular mechanism of the relay driving module 3, 3') to permit discharge of the energy stored in the energy storage component 32 to the latching relay 4, 4' for turning on the power supplying member 5 to operate the electronic device 1, 1' under the operating mode.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electronic device comprising:

a control unit generating a control signal according to an external signal;

a current limiting circuit receiving the external signal, and drawing an amount of current that does not exceed a current threshold from the external signal;

an energy storage component coupled electrically to said current limiting circuit for receiving the current from said current limiting circuit so as to store energy therein;

a latching relay coupled electrically to a common node of said current limiting circuit and said energy storage component, said latching relay including a switch, and first and second coils, each of said first and second coils having first and second terminals, a common node of said current limiting circuit and said energy storage component being connected electrically to said first terminals of said first and second coils of said latching relay;

a switch circuit coupled electrically to said energy storage component, and controlled by the control signal to selectively enable said energy storage component to discharge the energy stored therein so as to drive said latching relay, said switch circuit being controlled by two of the control signals, said switch circuit including:

a first transistor coupled electrically to said second terminal of said first coil of said latching relay, and controlled by a first one of the control signals to selectively enable said energy storage component to discharge the energy stored therein to said first coil of said latching relay for turning off said switch of said latching relay; and a second transistor coupled electrically to said second terminal of said second coil of said latching relay, and controlled by a second one of the control signals to selectively enable said energy storage component to discharge the energy stored therein to said second coil of said latching relay for turning on said switch of said latching relay;

a main operating component and a power supplying member connected electrically to said main operating component for driving operation of said main operating component, said switch of said latching relay having a first terminal that is adapted to be connected electrically to an external power source, and a second terminal that is connected electrically to said power supplying member for transmitting power supplied by the external power source to said power supplying member when said switch is turned on, so as to enable said power supplying member to drive operation of said main operating component, said main operating component being a liquid crystal display panel, the external signal including a power signal component and an image signal component, said control unit generating the control signals according to the image signal component, said current limiting circuit drawing the current from the power signal component.

2. The electronic device as claimed in claim 1, wherein said current limiting circuit is one of a resistor, a constant current circuit, and a constant current limiter.

3. The electronic device as claimed in claim 2, wherein the external signal includes a current component and a voltage component, said current limiting circuit being a resistor that has a resistance of at least the voltage component of the external signal divided by the current threshold of said current limiting circuit.

4. The electronic device as claimed in claim 1, wherein said energy storage component is one of a capacitor and a rechargeable battery.

5. The electronic device as claimed in claim 1, wherein the first one of the control signals generated by said control unit controls said first transistor to enable said energy storage component to discharge the energy stored therein to said first coil of said latching relay for turning off said switch of said latching relay when the image signal component of the external signal is maintained at a logic low level for a first predetermined duration.

6. The electronic device as claimed in claim 1, wherein the second one of the control signals generated by said control unit controls said second transistor to enable said energy storage component to discharge the energy stored therein to said second coil of said latching relay for turning on said switch of said latching relay when a second predetermined duration has elapsed since the external signal transitions from a logic low level to a logic high level.

7. The electronic device as claimed in claim 1, further comprising a by-pass switch adapted to be connected electrically between said power supplying member and the external power source for enabling the power supplied by the external power source to be transmitted to said power supplying member when said by-pass switch is turned on.

8. The electronic device as claimed in claim 1, further comprising an internal power source, and a backup switch that is coupled electrically between said internal power source and said current limiting circuit opposite to said energy storage component, said backup switch enabling current to be transmitted from said internal power source through said current limiting circuit to said energy storage component for storing energy therein when said backup switch is turned on.

9. The electronic device as claimed in claim 8, wherein said internal power source is a battery.

10. An electronic device comprising:

a control unit generating a control signal according to an external signal;

a current limiting circuit receiving the external signal, and drawing an amount of current that does not exceed a current threshold from the external signal;

an energy storage component coupled electrically to said current limiting circuit for receiving the current from said current limiting circuit so as to store energy therein;

an energy storage component coupled electrically to said current limiting circuit for receiving the current from said current limiting circuit so as to store energy therein;

a latching relay coupled electrically to a common node of said current limiting circuit and said energy storage component, said latching relay including a switch and a coil that has first and second terminals;

a switch circuit coupled electrically to said energy storage component, and controlled by the control signal to selectively enable said energy storage component to discharge the energy stored therein so as to drive said latching relay, said switch circuit being controlled by two of the control signals, said switch circuit including:

a first transistor coupled electrically to said first terminal of said coil of said latching relay;

a second transistor coupled electrically to said second terminal of said coil of said latching relay;

a third transistor coupled electrically between said energy storage component and said first terminal of said coil; and a fourth transistor coupled electrically between said energy storage component and said second terminal of said coil, said first transistor being controlled by a first one of the control signals to selectively turn on said fourth transistor and enable said energy storage component to discharge the energy stored therein through said fourth transistor to said coil of said latching relay for turning on said switch of said latching relay, and said second transistor being controlled by a second one of the control signals to selectively turn on said third transistor and enable said energy storage component to discharge the energy stored therein through said third transistor to said coil of said latching relay for turning off said switch of said latching relay; and a main operating component and a power supplying member connected electrically to said main operating component for driving operation of said main operating component, said switch of said latching relay having a first terminal that is adapted to be connected electrically to an external power source, and a second terminal that is connected electrically to said power supplying member for transmitting power supplied by the external power source to said power supplying member when said switch is turned on, so as to enable said power supplying member to drive operation of said main operating component, said main operating component being a liquid crystal display panel, the external signal including a power signal component and an image signal component, said control unit generating the control signals according to the image signal component, said current limiting circuit drawing the current from the power signal component.

11. The electronic device as claimed in claim 10, wherein the first one of the control signals generated by said control unit controls said first transistor to enable said energy storage component to discharge the energy stored therein through said fourth transistor to said coil of said latching relay for turning on said switch of said latching relay when a third predetermined duration has elapsed since the external signal transitions from a logic low level to a logic high level.

12. The electronic device as claimed in claim 10, wherein the second one of the control signals generated by said control unit controls said second transistor to enable said energy storage component to discharge the energy stored therein through said third transistor to said coil of said latching relay for turning off said switch of said latching relay when the image signal component of the external signal is maintained at a logic low level for a fourth predetermined duration.

* * * * *